US005163532A

United States Patent [19]

McCarty

[11] Patent Number: 5,163,532

[45] Date of Patent: Nov. 17, 1992

[54] FOLDING LADDER

[76] Inventor: George W. McCarty, Welford Rd., Lutherville, Md. 21093

[21] Appl. No.: 552,582

[22] Filed: Jul. 12, 1990

[51] Int. Cl.[5] ..... E06C 7/00; E05D 11/00

[52] U.S. Cl. ..... 182/163; 182/108; 182/46

[58] Field of Search ..... 182/163, 156, 24, 104, 182/107, 108, 214, 46, 27

[56] References Cited

U.S. PATENT DOCUMENTS

| | | | |
|---|---|---|---|
| 1,179,391 | 4/1916 | Bachman | 182/108 X |
| 2,371,460 | 3/1945 | Needham | 182/108 X |
| 3,447,631 | 6/1969 | Smith | 182/108 |
| 3,811,151 | 5/1974 | Kuemmerlin | 182/163 X |
| 4,216,844 | 8/1980 | Klafs | 182/104 |
| 4,371,055 | 2/1983 | Ashton et al. | 182/104 X |
| 4,407,045 | 10/1983 | Boothe | 182/163 X |
| 4,666,327 | 5/1987 | Su | 182/163 X |
| 4,666,328 | 5/1987 | Ryu | 182/163 X |
| 4,697,305 | 10/1987 | Boothe | 182/163 X |
| 4,773,503 | 9/1988 | Purkapile | 182/163 X |
| 4,842,098 | 6/1989 | Yuen | 182/163 X |
| 4,890,950 | 1/1990 | Yoo | 182/163 X |
| 4,947,959 | 8/1990 | Yuen | 182/163 X |

FOREIGN PATENT DOCUMENTS

| | | | |
|---|---|---|---|
| 2634752 | 2/1978 | Fed. Rep. of Germany | 182/27 |
| 2732654 | 2/1979 | Fed. Rep. of Germany | 182/163 |
| 0606760 | 11/1978 | Switzerland | 182/46 |

*Primary Examiner*—Karen J. Chotkowski
*Attorney, Agent, or Firm*—Leonard Bloom

[57] ABSTRACT

A folding ladder comprising multiple ladder sections pivotally joined together to permit the ladder to be articulated into and locked in a variety of configurations. Each ladder section includes a pair of side rails and a plurality of spaced rungs. The ladder end sections are identical and interchangeable. The ladder middle sections are identical and interchangeable. All side rails are reinforced by steel rods. The ladder sections are hinged together at their ends along one side of the ladder by master-type pivots and are hinged together at their ends along the opposite side of the ladder by slave-type pivots. Master pivots may be adjusted to a first position allowing the ladder sections to be moved with a detenting action and to a second position locking the ladder sections together in a selected position. Slave pivots follow the action of the master pivots, allowing all ladder adjustments to be made from one side. Side rails and rungs of each ladder section are formed integrally from resin impregnated glass fibers in a single molding operation. Only two different mold forms are required. An adjustable leveler is provided for legs of the end ladder section.

27 Claims, 12 Drawing Sheets 81
80, 84
77,85
14,16
32
31
78
80, 84
51
77
68
68
69
24, 28
8D
8E
52
23, 27
23, 27
40
8D
8E
40
41
41
40
24,28
40
69
53
69
68
68
26,36
25,37
71
74,86
71,87
75
74
72

46
46
47
47

FOLDING LADDER

FIELD OF THE INVENTION

The present invention relates to folding ladders. More particularly, it relates to a folding ladder of light weight, easily portable construction having improved locking hinge mechanisms and locking leveling legs.

BACKGROUND OF THE INVENTION

Folding ladders comprising multiple hinged sections are well known. Such ladders offer the conveniences of being collapsible to a compact size for ease of transportation and storage and of being extendible to a variety of lengths and configurations for use as a self supporting step ladder, a straight extension ladder or as a scaffold. Examples of folding ladders of the type of interest herein are seen in U.S. Pat. No. 3,474,881, issued Oct. 28, 1969; U.S. Pat. No. 4,815,564, issued Mar. 28, 1989; and U.S. Pat. No. 4,666,327, issued May 19, 1987.

To provide versatility in the selection of the configuration into which the ladder may be extended, the ladder sections are hinged together at their ends by pivoted joints which may be locked in any one of several selectable angular positions. The adjoining ladder sections then may be folded flat against one another for storage or transportation and may be unfolded to extend at various angles from one another and locked together for use in the desired configuration.

Examples of pivot joints or hinges of the known prior art designed for use in foldable ladders are seen in the following U.S. Pat. Nos. 3,655,012, issued Apr. 11, 1972; 3,955,240, issued May 11, 1976; 4,474,264, issued Oct. 2, 1984; 4,577,986, issued Mar. 25, 1986; 4,602,889, issued Jul. 29, 1986; 4,645,371, issued Feb. 24, 1987; 4,770,559, issued Sep. 13, 1988; 4,824,278, issued Apr. 25, 1989; and 4,805,737, issued Feb. 21, 1989.

Each of the hinges of the above-noted patents comprises two disk like members, one each of which is fixed to the end of one each of the opposed legs of two adjoining ladder sections. The disks are pivotally connected together to permit relative rotation and to secure the opposed ladder section legs together. One of the disk members includes a plurality of notches angularly spaced about the disk periphery. The other of the disk members carries a spring loaded pawl for engaging a selected one of notches of the first disk, thereby securing both disks against rotation. The second disk member also carries a lever or the equivalent for disengaging the pawl from a notch of the first disk to permit the adjoined ladder sections to be rotated to a different selected position.

Alternative means for locking the disks together are seen in the art. U.S. Pat. No. 4,666,327, issued May 19, 1987 and U.S. Pat. No. 3,811,151, issued May 24, 1974 both disclose a joint for a folding ladder in which the hinge members on the leg ends of one ladder section are formed as two disks spaced axially apart. The hinge members at the ends of the adjoining ladder section are each formed as a single disk, effectively, that fits between the spaced disks of the adjoining ladder section. The disks are journaled together for rotation about a common axis. A retractable pin is arranged to pass transversely through a hole in one of the outer disks of the hinge member at the end of a leg of one ladder section, through a selected one of several azimuthally spaced holes in the disk of the second hinge member at the end of the opposed leg of the adjoining ladder section, and finally pass into and seat in a hole in the other outer disk of the first hinge member. The holes of both disks of the first hinge member are aligned and the holes of the disks of both hinge members are spaced at the same radial distance from the axis of the hinge. By these means, the adjoining ladder sections may be locked together at a selected one of several different angular orientations.

U.S. Pat. No. 4,407,045, issued Oct. 4, 1983, discloses a hinge joint for a folding ladder with a locking mechanism similar to that of the '327 and '151 patents, except that two locking pins spaced on opposite sides of the hinge axis are provided. The pins are linked together for simultaneous retraction.

U.S. Pat. No. 4,773,503, issued Sep. 27, 1988, discloses a hinge for a folding ladder in which a disk is secured at the end of each of the opposing legs of the adjoining ladder sections. The disks of the opposed legs are journaled together in facing relationship for rotation about a common axis. The facing surfaces of each of the disks carry a toothed band so arranged that the teeth of each of the bands intermesh when the two mating disks are brought together. A camming device is mounted on one end of the axle that journals the two mating disks together to permit, in a released position, the disks to move apart axially sufficiently far to allow relative rotation between the toothed bands of the disks. In a locked position, the cam forces the disks tightly together, locking the toothed bands of the disks into engagement and preventing rotation of the hinge.

In the ladders of the above-referenced patents, the hinges joining the legs on both the right-hand and the left-hand sides of the ladder sections are identical, except that those on the left-hand side are the mirror images of those on the right-hand side. This arrangement requires that the hinges on both sides of adjoining ladder sections must be simultaneously unlocked in order to move the adjoining sections into a desired orientation. Then the hinges on both sides of the ladder sections must be simultaneously locked to secure the ladder sections in the selected orientation.

The following U.S. Patents of the known art show examples of ladders having adjustable feet for leveling the ladder:

U.S. Pat. No. 4,744,441, issued May 17, 1988, discloses a ladder having legs which terminate in a jack screw arrangement for adjusting the leg ends to different lengths to level the ladder. U.S. Pat. No. 3,447,631, issued Jun. 3, 1969, discloses a ladder having foot members slidably attached to the leg ends. An outwardly facing toothed rack bar is fixed along the length of the rear surface of each of the foot members. A U-shaped latch is pivotally secured at the front surface of the ladder leg near the end thereof so as to encircle the leg and the rack bar of the foot member with the bight of the latch overlying the teeth of the rack. The teeth of the rack are so oriented and the latch is so dimensioned that extension of a foot member relative to a leg end causes the bight of the latch to swing outward from the rack bar, disengaging the latch and permitting the foot member to slide downward along the leg. When the foot is extended to the desired length, a slight reverse movement of the foot member causes the latch to swing inward toward the rack bar and the bight of the latch to engage a tooth of the rack. The foot member is then held in place at the selected length so long as no relative movement between the foot member and the leg occurs.

The adjustable legs disclosed in U.S. Pat. No. 4,744,441 are tedious to manipulate when leveling the ladder, while the adjustable legs of U.S. Pat. No. 3,447,631 are not positively locked in place after adjustment.

Extension ladders of lightweight construction are disclosed in U.S. Pat. No. 3,009,522, issued Nov. 21, 1961; U.S. Pat. No. 4,029,172, issued Jun. 14, 1977; U.S. Pat. No. 3,502,173, issued Mar. 24, 1970 and U.S. Pat. No. 4,244,760, issued Jan. 13, 1981. In these ladders of the prior art, weight reduction is achieved principally through the substitution of resin impregnated fiber glass for wood or metal in the rails or stiles of the ladders.

U.S. Pat. No. 4,029,172 discloses a ladder in which the rails and rungs are molded as an integral piece using a foam plastic core and outer layers of impregnated fiber glass.

In the ladder of U.S. Pat. No. 3,009,532, the rails are constructed of layers of impregnated fiber glass wound on a balsa wood core. U.S. Pat. Nos. 3,502,173 and 4,244,760 disclose ladders in which the side rails are made of impregnated fiber glass, while the rungs are formed separately and are assembled to the side rails after the side rails are molded.

The ladders of light weight construction, except for that disclosed in U.S. Pat. No. 4,029,172, are fabricated in multiple steps in which the side rails and rungs are manufactured separately, then assembled and reprocessed.

Accordingly, it will be appreciated that there exists a critical need for a versatile folding ladder that is strong yet lightweight, readily portable, compact for convenient storage, has improved electrical safety, and is easy to articulate into a desired position for a variety of applications around the home or on the job, yet may be manufactured easily and economically for widespread merchandising and distribution to consumers, homeowners and do-it-yourselfers, as well as to professional mechanics, carpenters and tradesmen.

SUMMARY OF THE INVENTION

Accordingly, it is the principal object of the present invention to alleviate the disadvantages and deficiencies of the prior art by providing a versatile folding ladder that is strong, lightweight, compact, portable, easy to erect, has improved mechanical and electrical safety, and may be manufactured economically.

In accordance with the teachings of the present invention, there is herein disclosed a preferred embodiment thereof, constituting a versatile folding ladder articulatable in a plurality of configurations for a variety of respective applications, and wherein the ladder may be folded into a compact size for convenient storage and transportation. The ladder has respective sides including a first side and a second side; and the ladder further has a pair of middle sections pivotably joined together and further has a pair of end sections, including a first end section pivotably joined to one of the middle sections, and further including a second end section pivotably joined to the other of the middle sections, such that a plurality of pivot joints are formed between the respective sections. In the ladder of the present invention, the end sections each includes a pair of side rails and further includes a plurality of transverse rungs joined to the respective side rails. Each of the side rails is molded of a resin impregnated, fibrous material and has at least one reinforcing rod embedded therein and running substantially lengthwise of the respective rail. As a result, the ladder has a relatively high stiffness and strength and is relatively lightweight, besides having improved electrical safety. A "master" pivot means is provided all on the first side of the ladder and cooperates with "slave" pivot means all on the second side of the ladder at the pivot joints between the respective sections. With this structure, the ladder may be laid on its second side for locking and unlocking the pivot joints, such that the ladder may be conveniently adjusted to a desired articulated position.

In a preferred embodiment, the side rails include a pair of filets, and the reinforcing rods comprise metal rods embedded within the respective filets in the side rails. The rods are threaded along their entire lengths, or are otherwise mechanically keyed along their entire lengths, to the material of the side rails.

Preferably, the middle sections are substantially identical to each other; and the end sections are substantially identical to each other, thereby improving standardization and reducing manufacturing costs. In a preferred embodiment, the respective side rails on at least one of the end sections have foot means carried thereon, such that the ladder may rest upon the ground or floor; and at least one of the foot means is adjustable in height relative to the respective side rail, thereby facilitating a leveling of the ladder.

It is an object of the present invention to provide a folding ladder of high strength, light weight construction which may be collapsed into a compact size for convenience in storage and transportation.

It is another object of the invention to provide a folding ladder which may be arranged into a variety of configurations, any of which may be selected to afford a supporting structure best suited to the performance of the task at hand.

It is still another object of the invention to provide a folding ladder comprised of multiple, pivotally joined sections in which the pivot mechanisms at all joints of the ladder sections are controlled from the same side of the ladder, for convenience in changing the configuration of the ladder.

It is a further object of the invention to provide a ladder having legs of adjustable length for leveling the ladder, in which the length of the legs may be easily adjusted and positively locked in position after adjustment.

It is a still further object of the invention to provide a folding ladder comprised of multiple sections in which only two different forms of ladder sections are required.

It is another object of the invention to provide a ladder formed of multiple sections in which each of the sections are completely manufactured in a single molding step, thereby reducing the manufacturing cost of the ladder.

Other objects and advantages of the invention will become evident as a full understanding thereof is gained from the following complete description and accompanying drawings.

GENERAL DESCRIPTION OF THE PREFERRED EMBODIMENT

Figure 1:
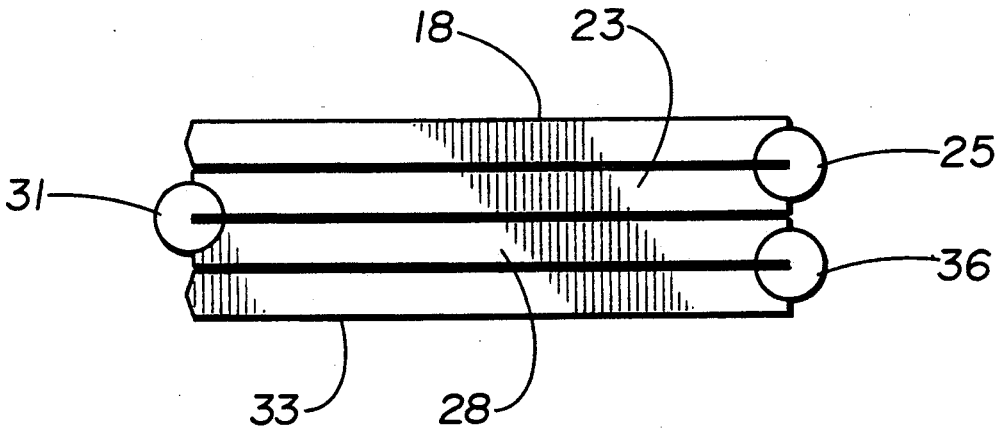
FIG. 1 is an elevation showing the ladder of the invention in a folded condition for transportation or storage.

The folding ladder of the present invention includes improved locking hinge joints for joining the foldable ladder sections together and for securely locking the adjoining sections in the various angular orientations that allow a folding ladder to be arranged in different versatile configurations.

Another feature of the folding ladder of the present invention is the provision in the end ladder sections of means for receiving a readily adjustable foot for leveling the ladder when the ladder is based on uneven ground. Improved means are provided for locking the foot to the ladder leg at a selected length.

Still another feature of the present invention is the provision of a folding ladder having high stiffness and strength and lightweight construction for ease of portability and erection at the selected site.

Briefly, the folding ladder of the invention comprises four pivotally joined ladder sections, each of which is formed of steel reinforced, resin impregnated glass fibers processed by injection molding. Fibrous materials other than glass fibers may be used in the manufacture of the ladder. For example, Kevlar or graphite fibers are suitable for use herein.

The two end sections of the ladder are identical and include hinge members at one end of the section and provision for adjustable feet on the leg ends at the other end of the section. The two middle sections are identical and include hinge members at each of the ends of a section. The hinge members of an end section are formed as a male component on one side of the section and as a female component on the opposite side of the section. The hinge members of a middle section of the ladder are formed as male components at both ends of the same side of the section and as female components at both ends of the opposite side of the section. Each of the hinge joints of the ladder is made up of a male component at the end of one of the adjoining ladder sections pivotally joined to a female component at one end of the other of the adjoining ladder sections. The pivot mechanisms for the hinge joints are either of a master-type or a slave-type.

The master-type pivot may be set in an adjustment position that spring loads together the male and female components of that joint or the master pivot may be set in a locked position that positively clamps those male and female components together. The slave-type pivot mechanism secures the male and female components of a joint together only by spring loading.

All joints on the same side of the ladder are fitted with master pivots while all joints on the opposite side of the ladder are fitted with slave pivots. Thus, the ladder may be laid on the side containing slave pivots in the joints, leaving the side containing master pivots in the joints upright. The master pivots can then be conveniently set in the adjustment position and the adjoining ladder sections can be moved into a desired angular relationship while the ladder is supported by the ground. After arranging the ladder in a desired configuration, all master pivots are set in the locked position and the ladder is turned upright for use. The master pivot is set in either the adjustment position or the locked position by means of an adjustment crank, and means are provided for locking the crank against rotation when the master pivot is set in the locked position.

The rungs, side rails and hinge components of a ladder section are molded as a single integral piece, thereby eliminating separate assembly and molding steps during fabrication. Only two different molds are required to manufacture the complete ladder.

Figure 2:
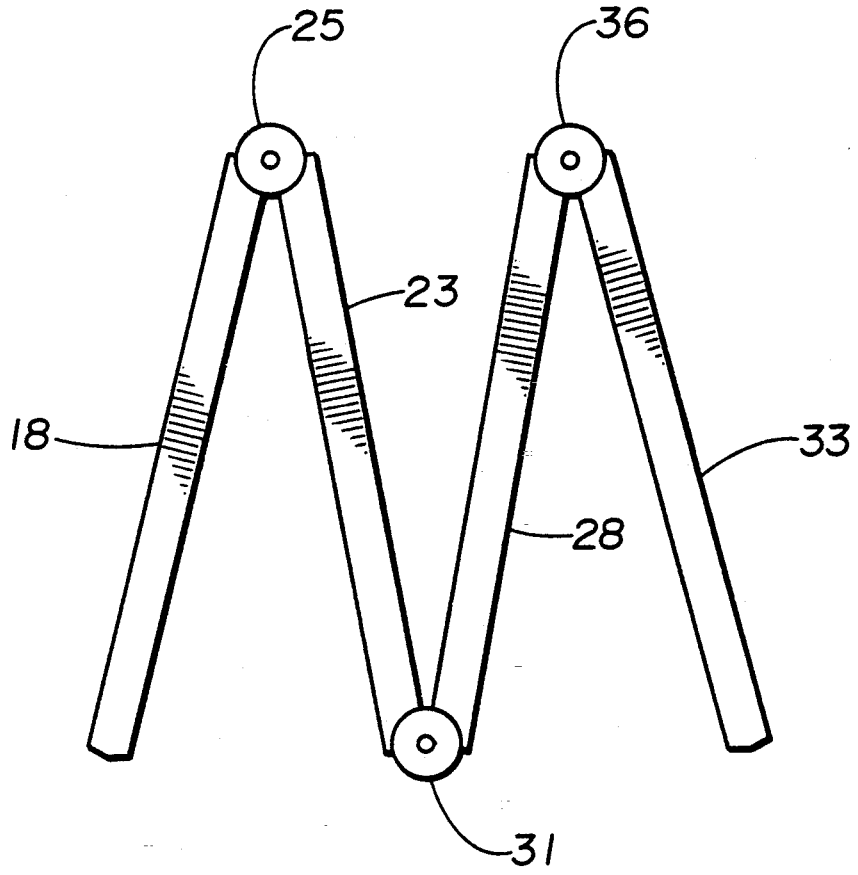
FIG. 2 is an elevation of the ladder of FIG. 1 shown partially expanded.
Figure 4:
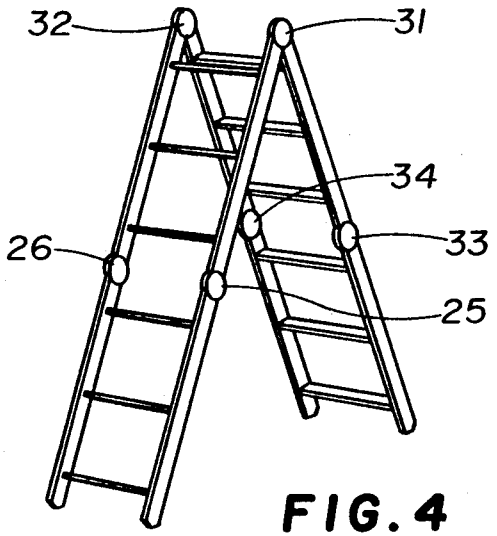
FIGS. 3–5 are isometric views of the ladder of FIG. 1 showing several of the configurations in which the ladder may be arranged.
Figure 5:
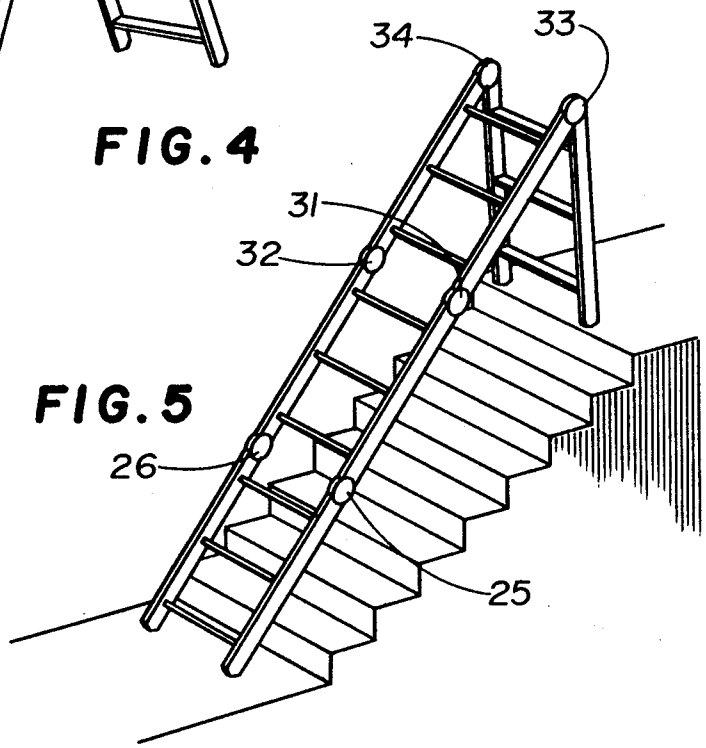
Figure 3:
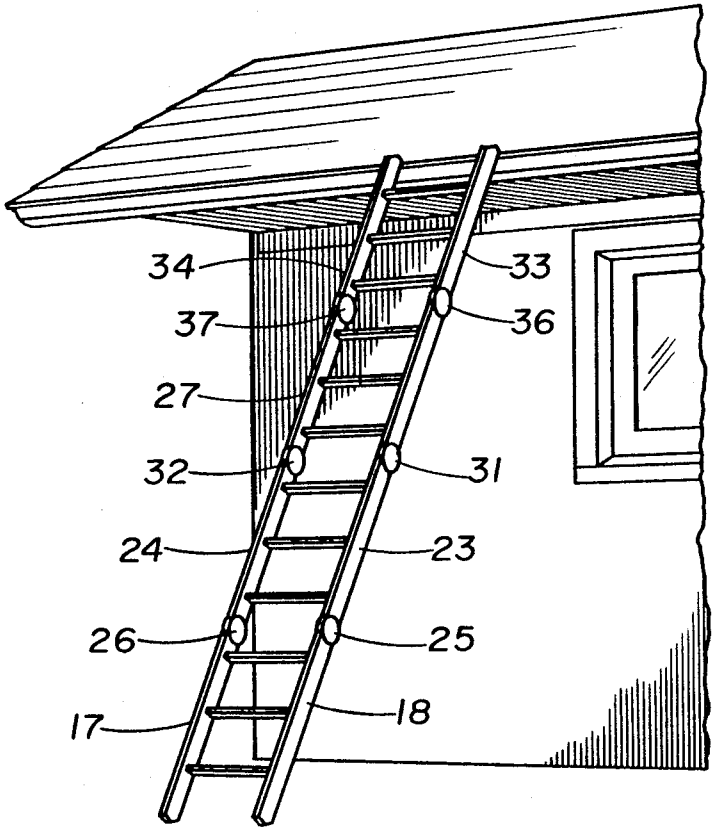
Figure 6:
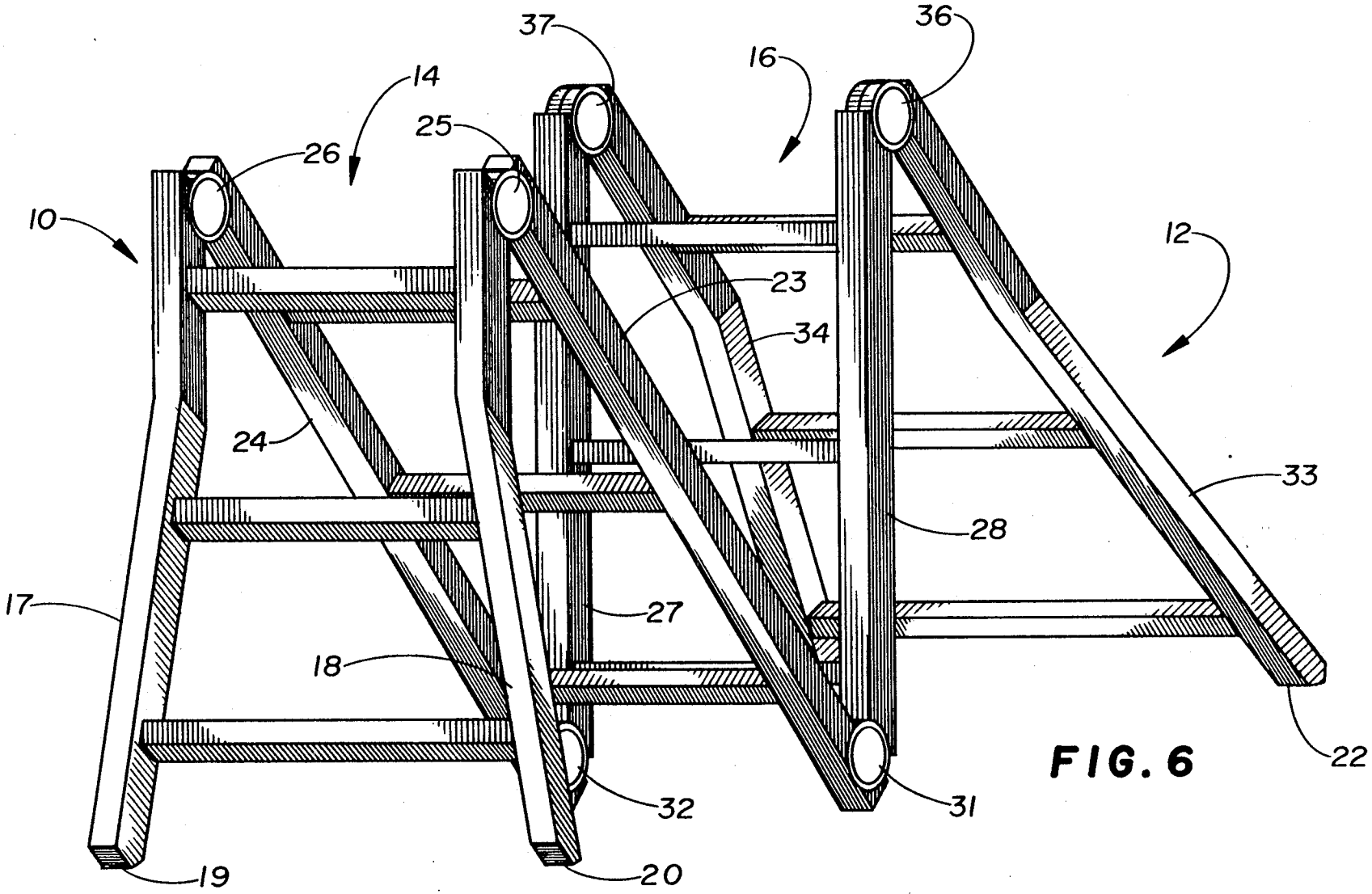
FIG. 6 is an isometric view of the ladder of FIG. 1 shown in a partially expanded condition.

Referring to FIG. 1, the ladder of the invention is seen folded for ease of transportation or storage. In FIGS. 2 and 6, the ladder is shown partially expanded, preparatory to arranging the ladder to any of the configurations shown in FIGS. 3-5 . FIGS. 3-5 illustrate various configurations into which the ladder , of the invention and conventional folding ladders may be arranged, any one of which would be selected according to the task at hand and the situation in which it is to be performed.

Referring to FIG. 6, the ladder comprises identical end sections 10 and 12 and identical center sections 14 and 16. The lower ends of end sections 10 and 12 are fitted with adjustable feet 19-22, hereinafter referred to as "leg levelers", for levelling the ladder when the ladder is placed on uneven ground. The upper ends of side rails 17 and 18 of end section 10 are pivotally connected to the ends of side rails 23 and 24 at one end of middle section 14 by hinge joints 25 and 26. The opposite ends of side rails 23 and 24 are pivotally connected to the side rails 27 and 28 at one end of middle section 16 by hinge joints 31 and 32. The opposite ends of side rails 27 and 28 are pivotally connected to upper ends of the side rails 33 and 34 of center section 12 by hinge joints 36 and 37.

The ladder is constructed entirely of injection molded, resin impregnated fiber glass, or equivalent fibers, except for the pivot mechanisms of the hinge joints, parts of the adjustable foot latching mechanisms, and for the steel reinforcement rods molded into the ladder side rails. The hinge joints are each formed in two mating sections, one each of which is formed integrally with one each of the ends of the side rails of the adjoining ladder sections. The ladder rungs are of a hollow box-like form in cross section and are molded integrally with the side rails, thereby eliminating the labor of assembly of the rungs to the side rails and improving the integrity of the ladder by eliminating the possibility of faulty rung to side rail joints. End sections 10 and 12 are identical and are interchangeable with one another. Center sections 14 and 16 are likewise identical and are interchangeable with one another. Only two separate molds are required for the manufacture of all four ladder sections.

As will later be described in detail, all hinge joints 25, 26, 31, 32, 36 and 37 are similar, with each joint comprising a disk shaped male component and a disk shaped female component of equal diameters. The male components are formed with two diametrically spaced, rounded studs. The female components are formed with a plurality of pairs of diametrically spaced, open-ended cylindrical bosses positioned at various azimuthal angles about the periphery of the disk. The disks are pivotally secured together along their centers in facing relationship by one or the other of a spring loaded pivot pin or a combined spring loaded pivot and threaded locking spindle. Then the studs of the male disk engage a particular pair of the bosses of the female disk to either secure the rails of the adjoining ladder sections temporarily together at a selected angle with a detenting action or to lock the rails together at the selected angle, as will later be described.

Figures 7A, 7B, 7C, 7D, 7E, 7F:
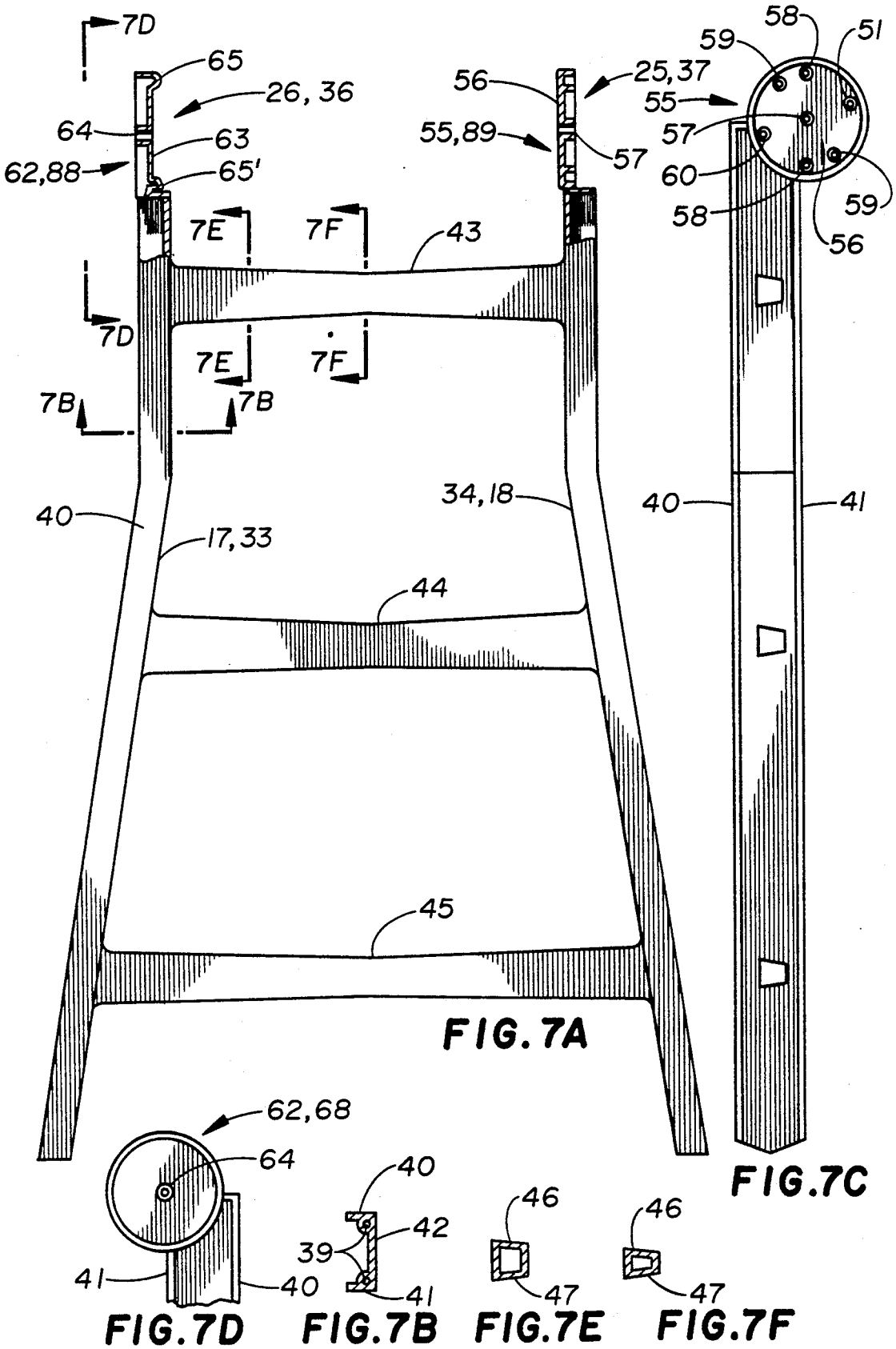
FIG. 7A is a front elevation of an end section of the ladder of the invention.
FIG. 7B is a cross section taken along the line 7B—7B of FIG. 7A.
FIG. 7C is a side view of the right hand side of the ladder section of FIG. 7A.
FIG. 7D is a partial side view of the upper end at the right hand side of the ladder section of FIG. 7A.
FIGS. 7E and 7F are cross sections of a ladder rung, taken along the lines 7E—7E and 7F—7F of FIG. 7.

FIG. 7A is a front elevation illustrating either of the end sections 10 or 12, with the portions of the hinge joints 25, 26, 36 and 37, formed integrally with the upper the ends of side rails 17, 18 and 33, 34 being shown in cross section. As seen in the cross section of FIG. 7B, all side rails 17, 18, 23, 24 etc., are formed as channels and include threaded steel reinforcement rods 39 imbedded in the fillets joining the outer flanges 40, 41 with the web 42 of the channel. All rungs of each of the sections 10, 12, 14 and 16 of the ladder are molded integrally with the side rails. As seen in cross section in the insets adjacent rung 43, all rungs are of a hollow, trapezoidal, box-like form, which tapers slightly from the outer ends of the rung toward the center of the rung to permit withdrawal of the mold core. The upper horizontal surfaces 46 of the rungs form the tread surfaces in the rungs 43-45 of the end sections 10 and 12. It is to be noted that the resins from which the ladder sections are molded characteristically shrink during the curing thereof and that such shrinkage prestresses the rods 39 in compression.

Figures 8A, 8B, 8C, 8D, 8E:
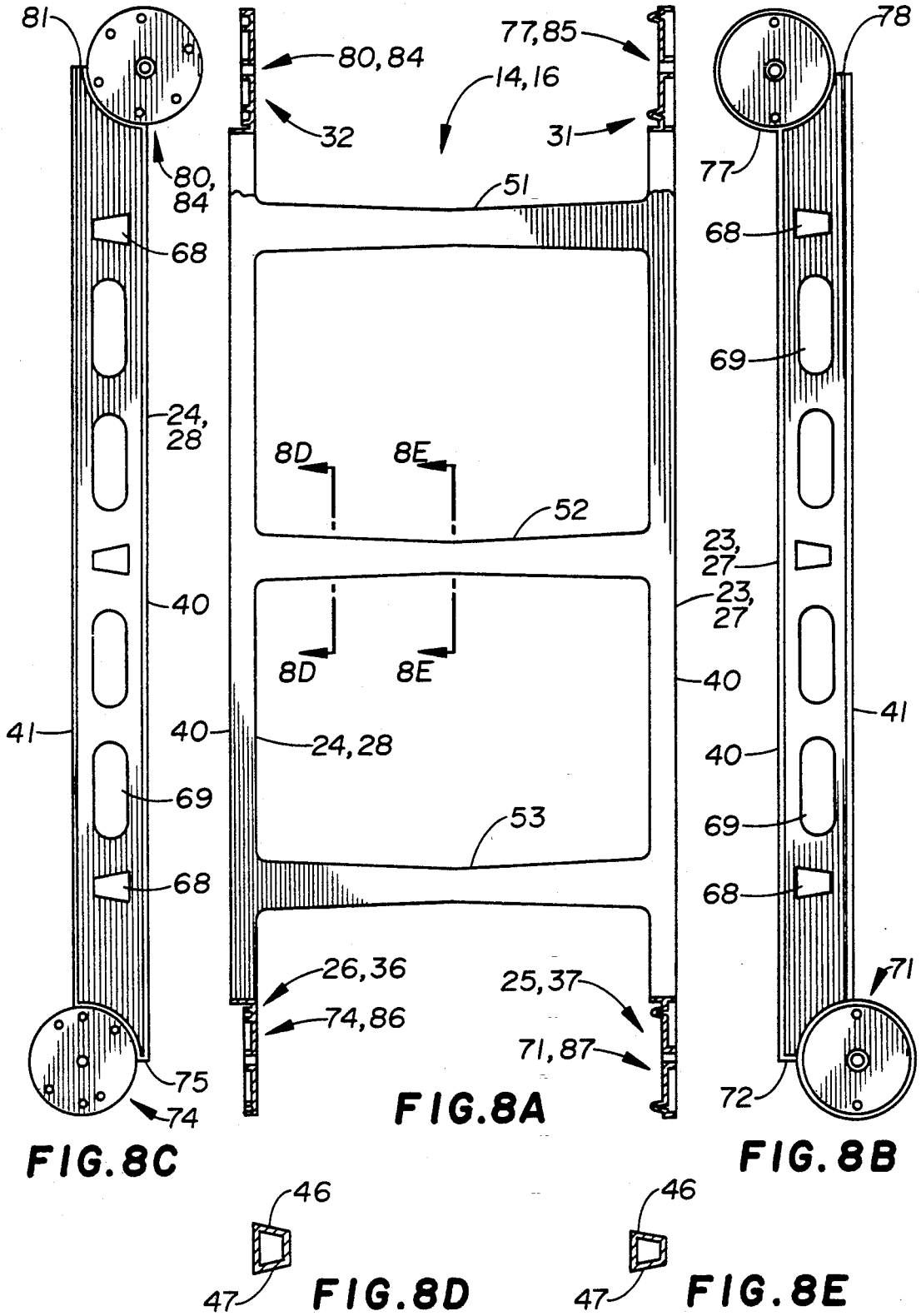
FIG. 8A is a front elevation, partially in section, of a middle section of the ladder of the invention.
FIG. 8B is a side view of the right hand side of the ladder section shown in FIG. 8A.
FIG. 8C is a side view of the left hand side of the ladder section of FIG. 8A.
FIGS. 8D and 8E are cross sections of a ladder rung taken along the lines 8D—8D and 8E—8E of FIG. 8A.

Referring briefly to FIG. 8A, in middle section 14, the upper surfaces 46 of the rungs form the tread surfaces of rungs 51-53. Middle section 16 is identical to middle section 14, but is oriented differently from middle section 14 for installation in the ladder. That is, middle section 16 corresponds to middle section 14 turned end-for-end for installation in the ladder. Therefore, in the rungs of middle section 16, corresponding to rungs 51-53 of middle section 14 (FIG. 8A), the lower surfaces 47 form the rung tread surfaces. The box-like cross sectional form of each of the rungs imparts high shear and bending strength to the rung, while the trapezoidal form thereof provides rung tread surfaces which are slightly inclined toward the inner side of the ladder when the ladder is put in service. This inwardly sloping tread surface tends to cause the user to lean forward toward the ladder, when standing on a rung, and aids in preventing slippage of the user's foot from the rung.

Referring to FIGS. 7A and 7C, the upper end of right side rail 18 of end section 14, and corresponding upper end of right side rail 34 of end section 12, are each formed with the female component 55 of their respective joints 25 and 37. Female component 55 comprises a dish-like disk 56 of a depth equal to approximately one-half the width of a flange 40 or 41 of a side rail. Female component 55 is formed with a central hub 57 and three pairs of outwardly facing bosses 58, 58', 59, 59' and 60, 60,' spaced about the periphery of disk 56. The bosses of each pair are diametrically opposed. Bosses 58, 58' lie on a diameter of disk 56 that parallels the longitudinal axis of side rail 18. Bosses 59, 59' and 60, 60' lie on diameters of disk 56 that are angularly spaced from the diameter containing bosses 58, 58' by amounts corresponding to the angular relationship of adjoining ladder sections for the various configurations in which the ladder may be placed. The radius of disk 56 is equal to about 80% of the distance between the flanges 40 and 41 of the side rails. The disk center is aligned with the end of the side rail and is offset slightly beyond a continuation of the outer surface of flange 41 of the side rail. Such an offset provides a small clearance between the facing flanges of the side rails when the ladder is folded flat.

Referring to FIGS. 7A and 7D, the upper end of the left side rail 17 of end section 10, and corresponding end of side rail 33 of end section 12, is formed with the male component 62 of hinge joints 24 and 36. Male component 62 comprises a dish like disk 63 of the same size as disk 56 of female component 55 and includes a central hub 64, the center of which is aligned with the center of hub 57 of female component 55. Hub 64 is internally threaded, as will later be described. Two inwardly facing, diametrically opposed male studs 65 and 65' are positioned near the periphery of disk 63 at the proper spacing to engage a selected pair of the bosses of the mating female component on the side rail of the adjoining ladder section. For joint 26, such female component will be located on side rail 24 of middle section 14. For joint 36, such female component will be located on side rail 28 of middle section 16. Studs 65 and 65' are hollow at the center. The openings in the outer surface of disk 63, through which the mold cores for the studs are withdrawn, are seen in FIG. 7D at 66 and 66'. Studs 65 and 65, lie on the diameter of disk 63 that parallels the longitudinal axis of side rail 17 of end section 10 or, correspondingly, the longitudinal axis of end section 12.

FIGS. 8A–8C illustrate either of the middle sections 14 or 16. Considering first middle section 14, side rails 23 and 24 are of the same cross sectional form as shown in FIG. 7B and include steel reinforcement rods 39 running the length of the side rails within the fillets joining the outer flanges 40, 41 with the web 42 of the channel. Three rungs 51–53 are spaced along the length of the section. Rungs 51–53 are of the same cross sectional form as described with respect to rungs 43 et al., FIG. 7A. The holes 68 through which the mold cores for the rungs are withdrawn are seen in FIGS. 8B and 8C. Also seen in these FIGS. are lightening holes 69 spaced along the side rails for reducing the weight of the ladder. The male component 71 that mates with the female component 55 in joint 25 is molded integrally with side rail 23 at the lower end thereof. Male component 71 is identical in form to male component 62 described with reference to FIGS. 7A and 7D. The center of male component 71 is aligned with the end 72 of side rail 23 and is offset from the outer surface of flange 41 an amount equal to the offset of the center of the female component 55 from a continuation of flange 41 of side rail 18.

At the opposite side of section 14, the female component 74 that mates with the male component 62 of end section 10 is molded integrally with the lower end of side rail 24. Female component 74 is identical in form to female component 55 described with reference to FIGS. 7A and 7C. The center of female component 74 is aligned with the end 75 of side rail 24 and is offset from the outer surface of flange 41 an amount equal to the offset of the center of male component 62 from the outer surface of flange 41 of side rail 17.

At the upper end of section 14, the male component 77 of joint 31 is formed integrally with the upper end of side rail 23. Male component 77 is identical in form to male component 71. The center of male component 77 is aligned with the end 78 of side rail 23 and is offset beyond a continuation of the outer surface of flange 40 an amount equal to the offset of the center of male component 71 beyond a continuation of the outer surface of flange 41. The amounts of the offsets of the centers of male components 71 and 77 from the outer surfaces of side rail 23 are equal, but it is to be noted that the offsets are from the outer surfaces of the opposite flanges 41 and 40, respectively.

At the opposite side of the upper end of section 14, the female component 80 of joint 32 is formed integrally with the upper end of side rail 24. Female component 80 is identical in form to female component 74. The center of female component 80 is aligned with the end 81 of side rail 24 and like male component 77, the center is offset beyond a continuation of the outer surface of flange 40 an amount equal to the offset of the center of male component 77 from a continuation of the outer surface of flange 40 of side rail 23.

Middle section 16 is identical to middle section 14 but is oriented differently from middle section 14 for assembly in the ladder. A section identical to section 14, hereafter referred to as section 16, is turned end-for-end to bring the end of section 16 corresponding to the upper end of section 14 into line with the upper end of section 14. The female component 84 of section 16, corresponding to female component 80 of section 14, is then adjacent to the male component 77 of section 14 and the male component 85 of section 16, corresponding to the male component 77 of section 14, is adjacent to female component 80 of section 14. The female component 86 of section 16, corresponding to female component 74 of section 14, and the male component 87 of section 16, corresponding to male component 71 of section 14, will then be respectively positioned to register with the male component 88 of section 12, corresponding to male component 62 of section 10, and the female component 89 of section 12, corresponding to the female component 55 of section 10.

Figure 9:
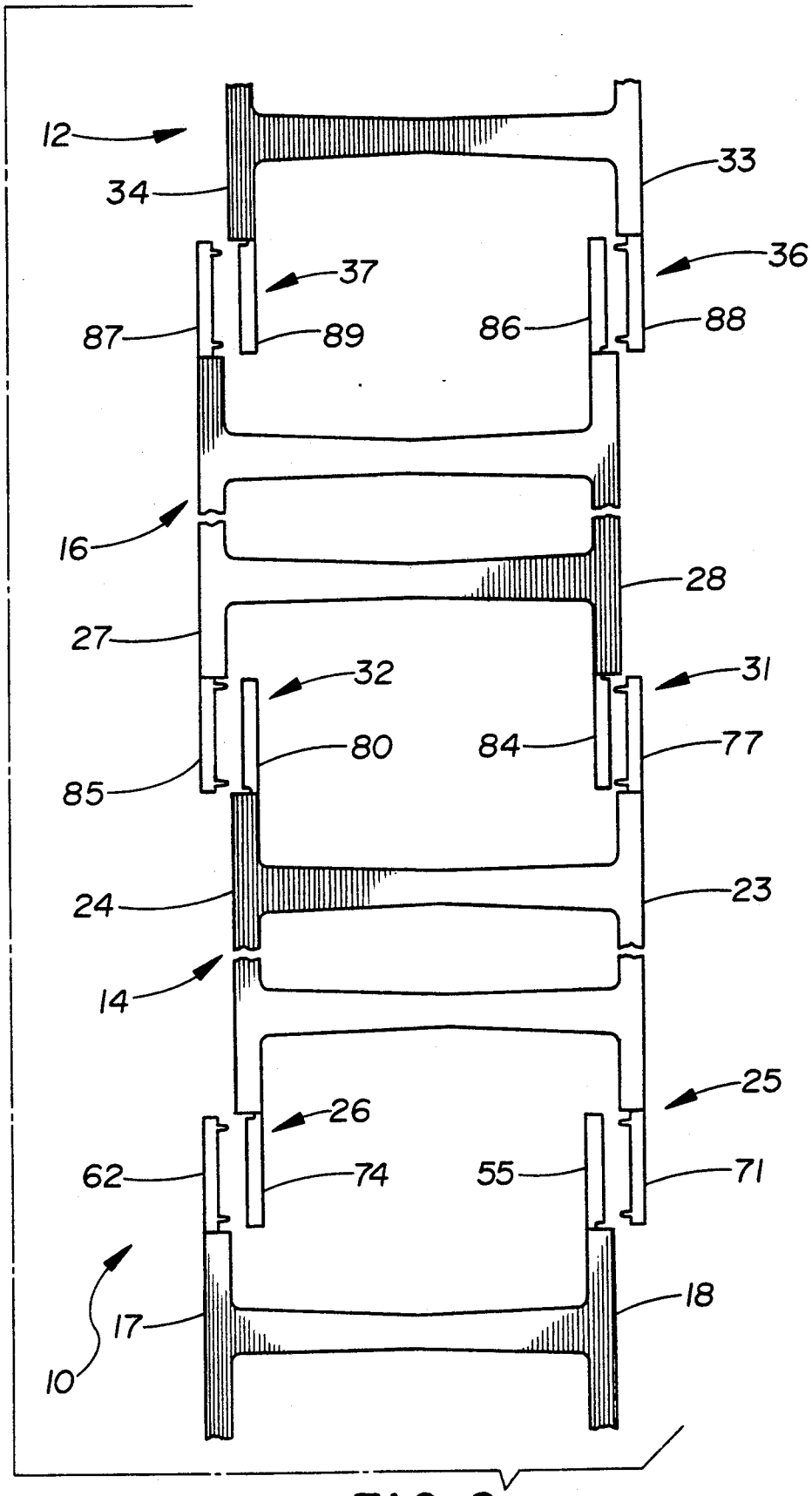
FIG. 9 is a fragmented front elevation, partially in section, showing the manner of assembly of two of the end sections shown in FIG. 7A, with two of the middle sections shown in FIG. 8A.

In FIG. 9, the joint ends of ladder sections 10, 14, 16 and 12 are shown positioned for assembly into the ladder. FIG. 9 particularly illustrates the mating components of joints 25 and 26, 31 and 32, and 36 and 37. Joints 25 and 26 are respectively formed by registry of male component 71, section 14, with female component 55, section 10, and by registry of male component 62, section 10, with female component 74, section 14. Joints 31 and 32 are respectively formed by registry of male component 77, section 14, with female component 84, section 16, and by registry of male component 80, section 14, with female component 85, section 16. Joints 36 and 37 are respectively formed by registry of male component 88, section 12, with female component 86, section 16, and by registry of male component 87, section 16, with female component 87, section 16.

The master-slave pivot mechanisms for joints 25, 26 et al. will next be described with particular reference to FIGS. 10 and 11. Briefly, the male and female components of all joints along one side of the ladder, preferably the right-hand side, are connected together by the master type pivot mechanisms. The male and female components of all joints on the opposite side of the ladder, i.e., the left-hand side, are connected together by the slave-type pivot mechanisms. The master pivot mechanism may be set, by means of an adjusting crank, into either an adjustment condition or a locked condition.

In the adjustment condition, the male and female components of the joints on both sides of the ladder are spring loaded together so that the ladder sections that are coupled together by those joints may be easily manipulated into a selected angular relationship and a detenting action will occur as the studs of the male components of a joint encounter successive pairs of the bosses of the female components of the joint.

In the locked condition, the male and female components of a joint held together by a master pivot mechanism are drawn into tight engagement by the master pivot mechanism, which acts as a bolt to secure those components tightly together. At the same time, because of the lateral stiffness of the ladder sections, the male and female components of the joint at the opposite side of the ladder that are held together by a slave pivot mechanism are secured in tight engagement.

Figure 10:
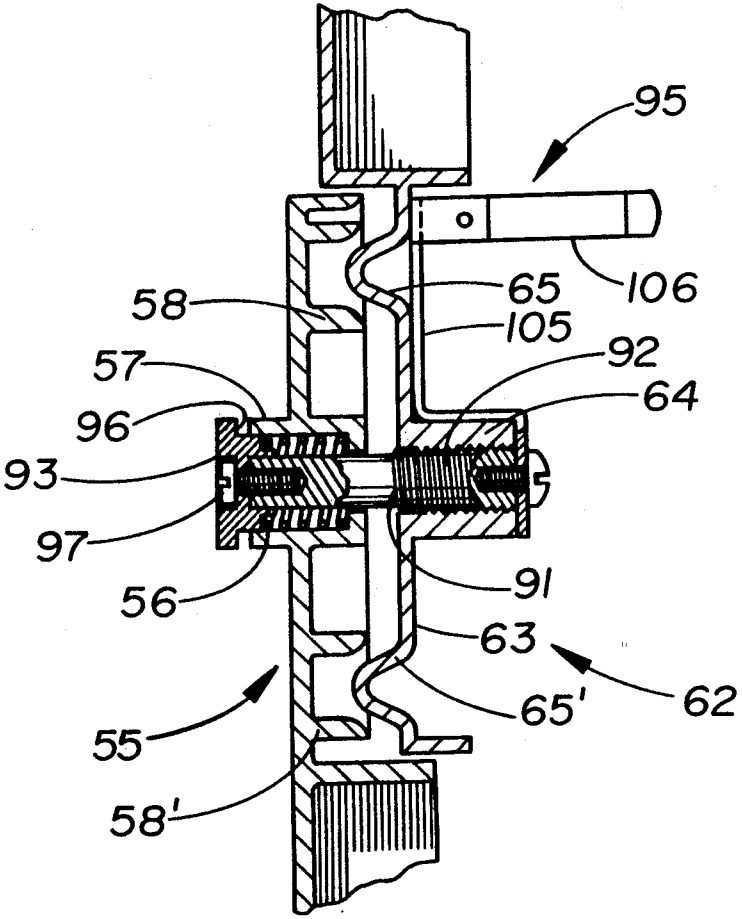
FIG. 10 is a cross section of the hinge joints connecting two adjacent ladder sections showing the pivot mechanisms thereof in the adjustment position.
Figure 10:
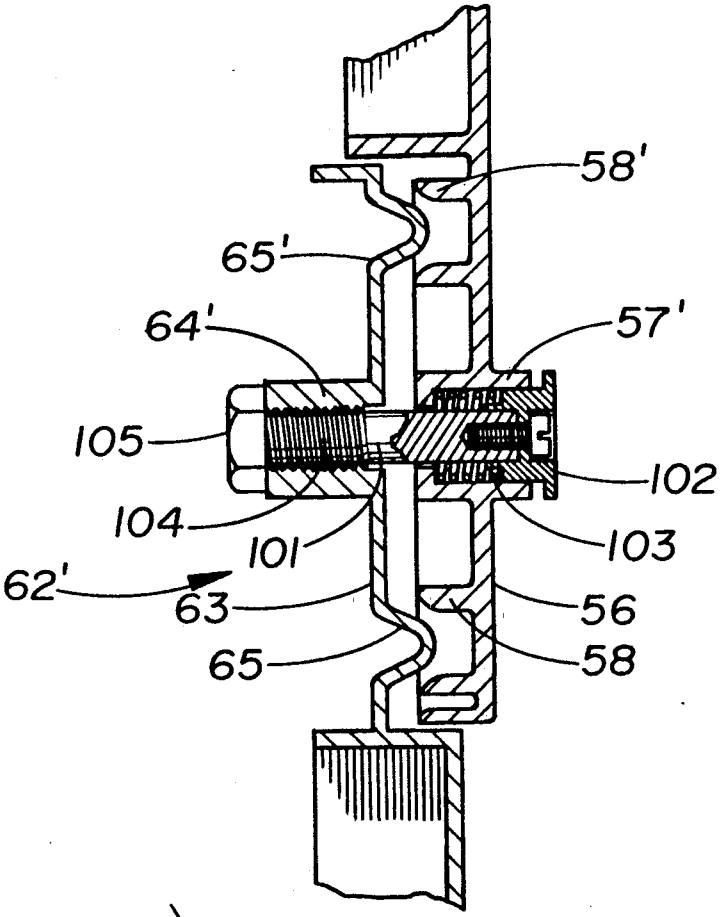

FIG. 10 illustrates a typical pair of opposed joints with the master pivot mechanism placed in the adjustment condition. The master pivot mechanism comprises a spindle 91 threaded along the length 92 that passes through the internally threaded hub 64 of the male component 62 of a joint. The spindle end opposite the threaded portion is terminated by a shouldered bushing 93 fixed to the end of spindle 91 by a lock screw 97. Bushing 93 fits slidably and rotatably in the hub 57 of the mating female component 55. A coaxial compression spring 94 is captured within the hub 57 of female component 55 between the end of bushing 93 and the bottom of hub 57. The spindle is rotatable by an adjusting crank 95 to cause the spindle to move axially back and forth within the hubs 57 and 64 of the male and female components of the joint. The shoulder 96 of bushing 93 extends over the external rim of hub 57 of the female component so as to bear on hub 57 when the spindle is rotated in the direction to cause the spindle to back out of the hub 64 of the male component 62. Further rotation of the spindle in the same direction forces bosses 58 of the female component 55 into tight facing engagement with the studs 65 of the male component, through the action of the bushing shoulder on the hub of the female component. In this position of the spindle 93, the joint is in the locked condition illustrated in FIG. 11. Further features of the locked condition will later be described with reference to FIG. 11.

Continuing with reference to FIG. 10, the spindle 91 is shown rotated into the hub 64 of the male component 62, causing the shoulder 96 of the bushing to back away from the rim of hub 57 of the female component 55. In this position of the spindle, the compression spring 94 biases the female component 55 into resilient engagement with the male component 62. When force is then applied to the adjoining ladder sections to cause rotation of the sections relative to one another, the studs of the male component lift out of the bosses of the female component against the force of the compression spring. Continued rotation of the ladder sections moves the studs of the male component toward the next adjacent pair of bosses of the female component. The studs will then engage the bosses with a detenting action.

The slave-type pivot mechanism of the joint at opposite side of the ladder comprises a bolt 101, shouldered bushing 102 and compression spring 103. Bolt 101 is similar to the spindle 91 of the master pivot except that the end bolt 101 adjacent the threaded portion 104 is finished with a hex head 105 that is seated against the external rim of the hub 64' of the male component 62, at that side of the ladder to secure bolt 101 fixedly in hub 64'.

Like the master pivot, the compression spring 103 of the slave pivot is captured within the hub 57' of the female component 55' between the end of bushing 102 and the bottom of hub 57,. The slave-type pivot exerts only a spring bias force against the female component 55' of the joint to provide a detenting action between the male component 55' and the female component 62', similar to the detenting action of the master pivot when the spindle 91 of the master is rotated into the hub 64 of male component 62.

Figure 11:
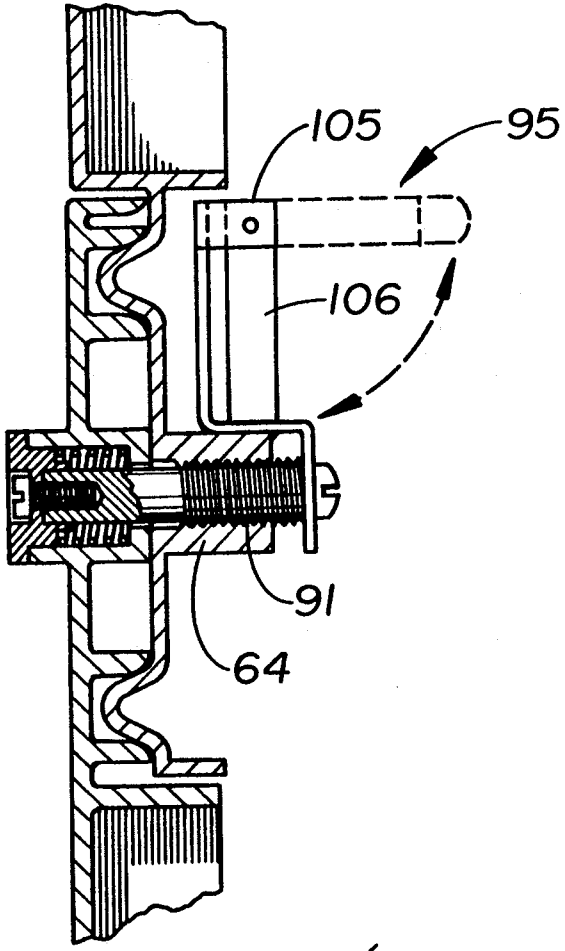
FIG. 11 is a cross section, similar to FIG. 10, showing the hinge joint pivot mechanisms in a locked condition.
Figure 11:
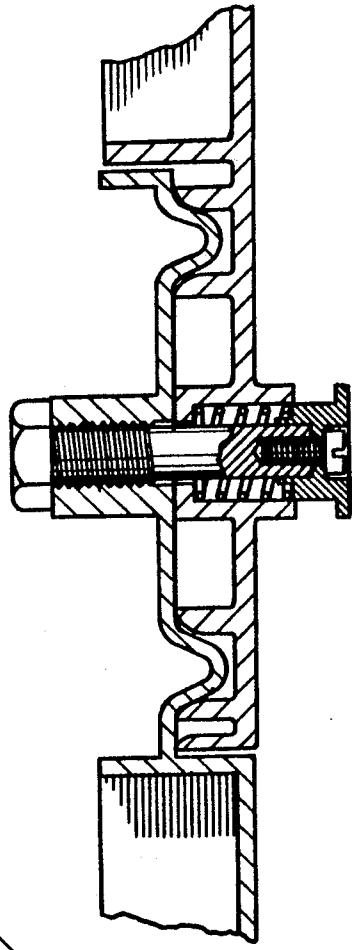

FIG. 11 shows the joints with spindle 91 rotated out of hub 64 to place the joints in a locked condition. Spindle 91 is rotated by means of an adjusting crank 95 having a crank arm 105 and a handle 106 that is pivotally mounted to the outer end of crank arm 105. Handle 106 may be swung outward for use during rotation of spindle 91, as seen in FIG. 10, or swung inward to lock the spindle against rotation, as seen in FIG. 11.

Figure 12A:
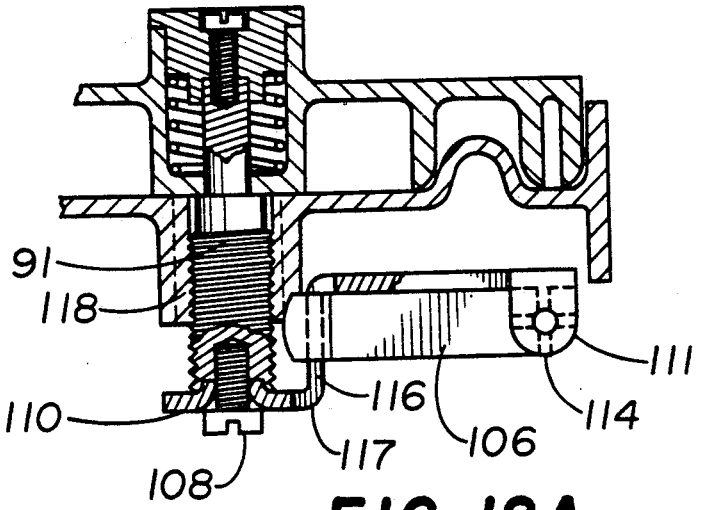
FIG. 12A is a cross section of a portion of a typical hinge joint having a master pivot mechanism showing details of the means for locking the pivot mechanism.
Figure 12B:
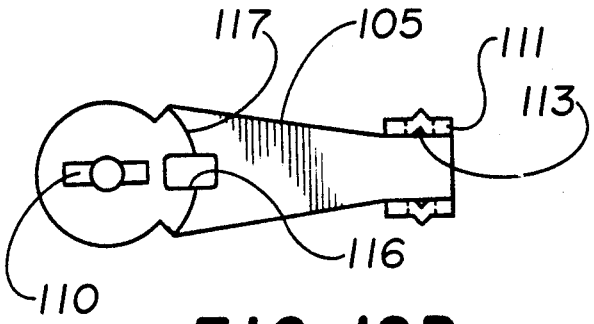
FIGS. 12B and 12D show details of the crank arm and handle of a master pivot mechanism.
Figure 12C:
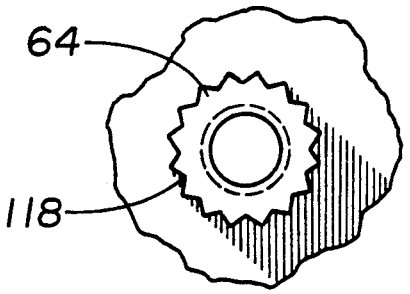
FIG. 12C is a plan view of the hub of the male component of a typical hinge joint of the ladder of the invention.
Figure 12D:
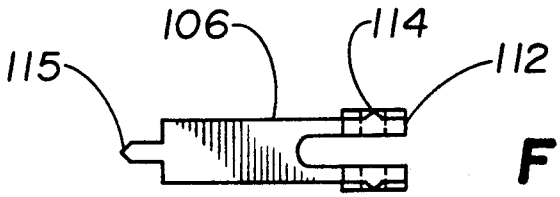

FIGS. 12A–12C show the crank arm 95 and hub 64 in greater detail to illustrate the means by which the spindle is locked against rotation. Referring to FIGS. 12A and 12B, the lower end 107 of crank arm 105 is pierced at the center to provide passageway for a retaining screw 108 that is threaded into the end of spindle 91 and to provide two inwardly bent tangs 110. Tangs 110 fit into keyway slots formed in the end of spindle 91 to fix the crank arm against rotation relative to the spindle. The upper end of crank arm 105 is formed with two outwardly extending ears 111 between which the inner end 112 of handle 106 is mounted. The facing surfaces of ears 111 are formed with crossed grooves 113 that are engaged by ridges 114 on the outer surfaces of handle end 112 to provide a detent action when handle 106 is swung between the adjusting and the locked positions. The outer end of handle 106 is formed with a tang 115.

As seen in FIG. 12C, the exterior side wall of each of the hubs 64 of all the male components 62 of the ladder joints is formed with a plurality of evenly spaced, V-shaped grooves 118 that extend axially along the hub. When handle 105 is swung inward to a locked position, tang 115 passes through a slot 116, formed in portion 117 of crank arm 105, and enters one of the grooves 118 of hub 64. Crank arm 95 and spindle 91 are thereby locked against rotation.

The internal threads of the hubs of the male components of the joints and the threads of the spindles and the bolts of the pivot mechanisms are preferably left-hand threads. Then, when the adjusting crank of a master pivot is rotated in the clockwise direction, the spindle will move out of the hub to place the joint in a locked condition. The left-hand threads are preferred since it is to be expected that a user will instinctively turn the adjusting crank in a clockwise direction in order to lock a joint.

The placement of all master pivot mechanisms for all the joints of the ladder along the same side of the ladder, preferably the right-hand side, is a substantial advantage when the configuration of the ladder is changed. Such placement allows the left side of the ladder to be laid on the ground with the right side of the ladder upright. Then the master pivots are set in the adjustment position while the ladder sections are arranged in the desired configuration. Finally, the master pivots are set in the locked position and the adjustment cranks are locked. During these procedures, the ladder is supported entirely by the ground, reducing the effort required to alter the configuration of the ladder.

Figure 13:
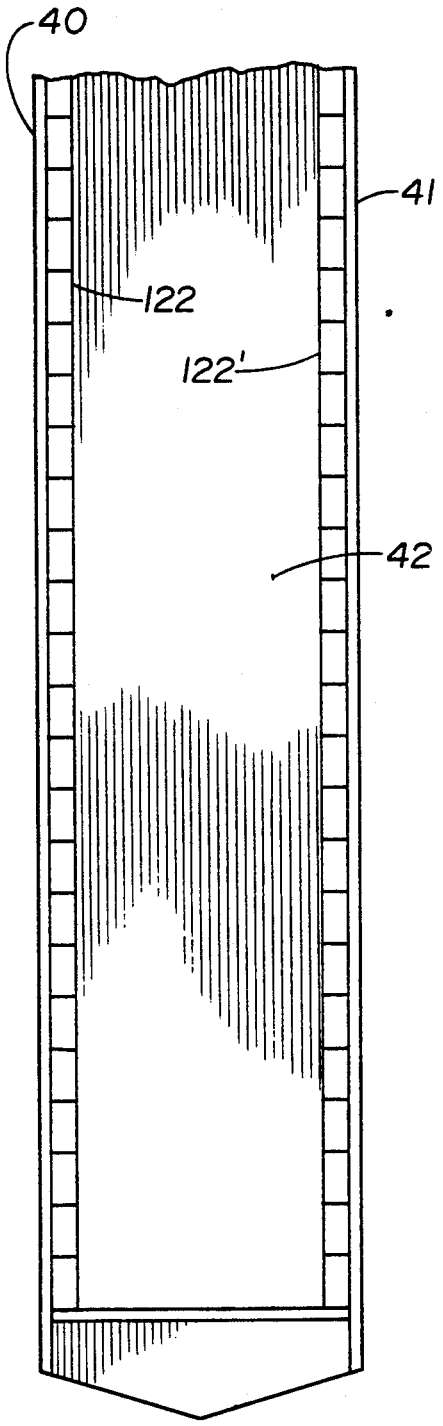
FIG. 13 is a view of the lower end portion of a typical leg of an end section of the ladder showing the racks of ratchet teeth thereon for use with an adjustable foot for the ladder.

One or more of the ends of the legs of end sections 10 and 12 of the ladder may be provided with leg levelers 19, 20 and 22, 24, briefly mentioned above in connection with FIG. 6. FIG. 13 is an elevation of the lower end of side rail 18 of end section 10, which is typical of the ends of all four legs of end sections 10 and 12. Racks 122, 122' of ratchet teeth (not shown in FIG. 7C) are superimposed on the fillets joining the flanges 40, 41 with the web 42 of side rail 18. The reinforcement rods 39 (FIG. 7B) embedded within those fillets lie beneath racks 122 and 122'.

Figure 14:
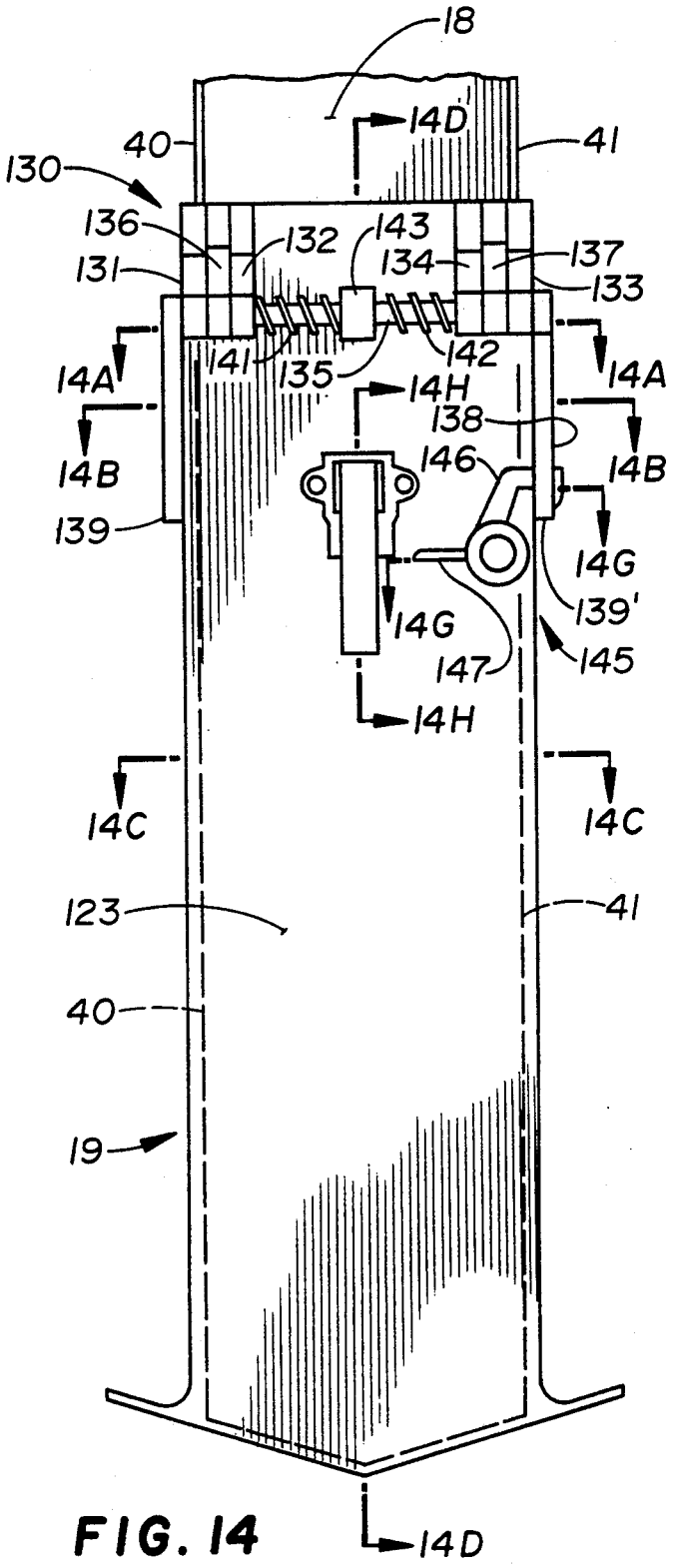
FIG. 14 is a side view of the end of a typical leg of a ladder end section showing an adjustable foot installed thereon.
Figure 14A:
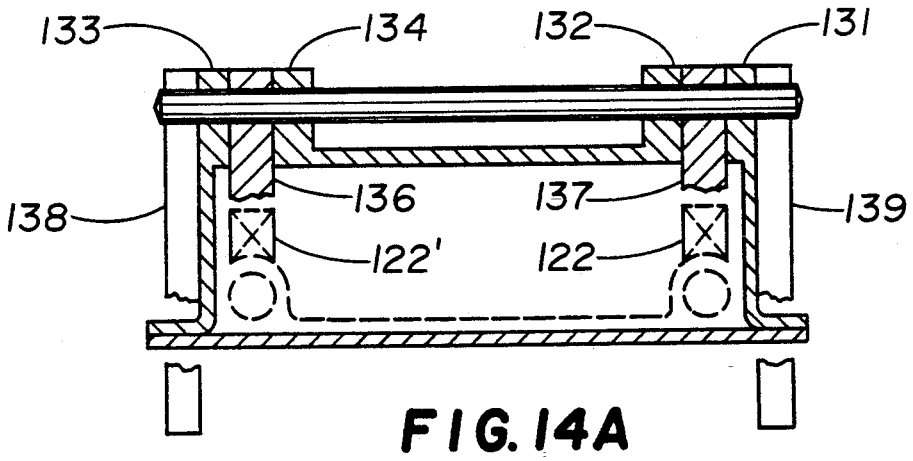
FIG. 14A is a section taken along the line 14A—14A of FIG. 14.
Figure 14B:
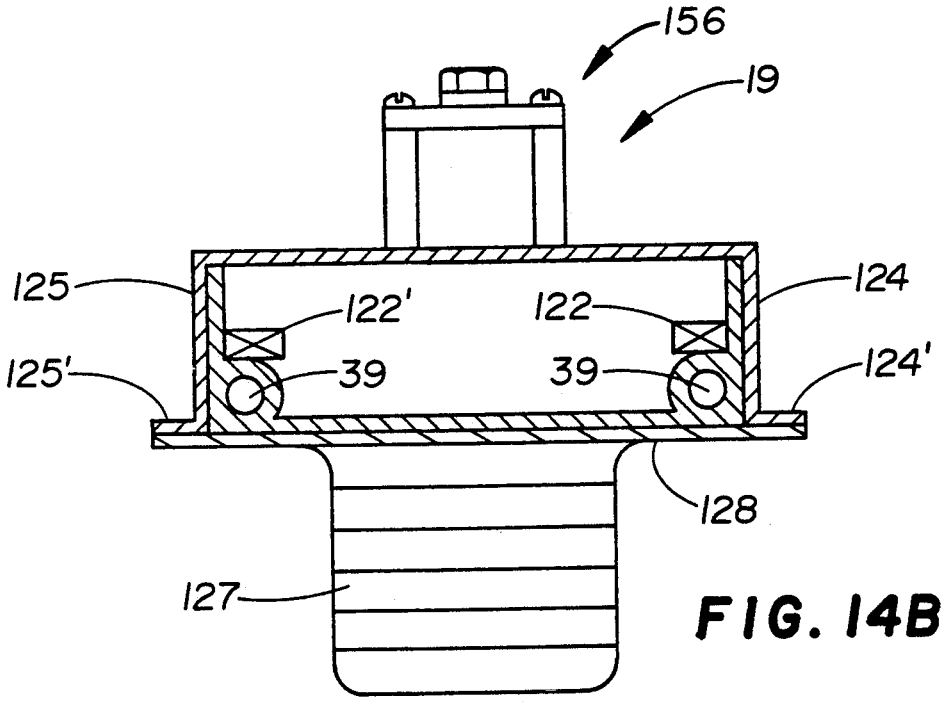
FIG. 14B is a section taken along the line 14B—14B of FIG. 14.
Figure 14C:
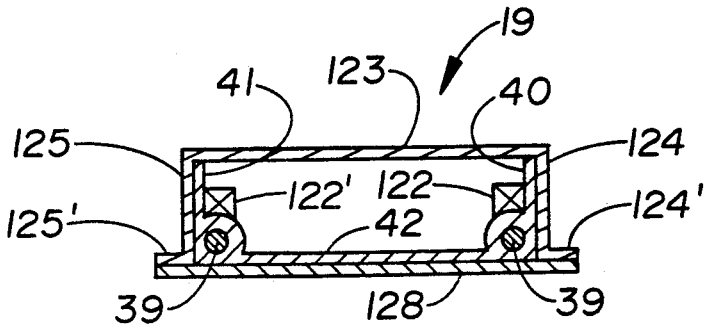
FIG. 14C is a section taken along the line 14C—14C of FIG. 14.

FIG. 14 is an elevation of a leg leveler 19 fitted to the end of side rail 18 and FIGS. 14A–14C are sections taken along the length of leveler 19. As best seen in FIG. 14C, the body of leveler 19 is rectangular in cross section and is formed by a generally U-shaped channel, the web 123 of which extends across the outer edges of flanges 40, 41 of side rail 18 and the sides 124, 125 of which extend over the outer surfaces of flanges 40, 41 with a close sliding fit. The ends of sides 124, 125 are turned outward to form flanges 124', 125'. A back plate 128 extends across the outer surface of web 42 of side rail 18 and is fixed along its edges to flanges 124', 125', suitably by ultrasonic welding. Leveler 19 is thus retained over the end of side rail 18 as a sliding cover.

The bottom end of leveler 19 is finished with two planar flanges 126, 126' which intersect the longitudinal axis of leveler 19 at angles of 15 degrees to the normal, so as to lie flat on the ground when the ladder is placed against a wall at the usual 15 degree angle. A pedal 127 (FIG. 14D) projects inward from the lower end of leveler 19. Pedal 127 enables the user to adjust the length of leveler 19 by stepping on the pedal until one of the flanges 126 or 126' contacts the ground, while the ladder is being held level.

Figure 14E:
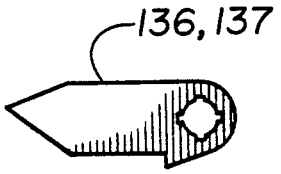
FIGS. 14E and 14F show the pawl and operating lever used in the ratchet of the adjustable foot of FIG. 14.
Figure 14F:
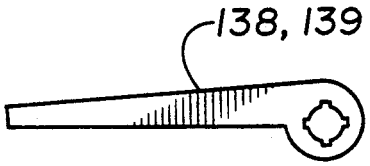
Figure 14D:
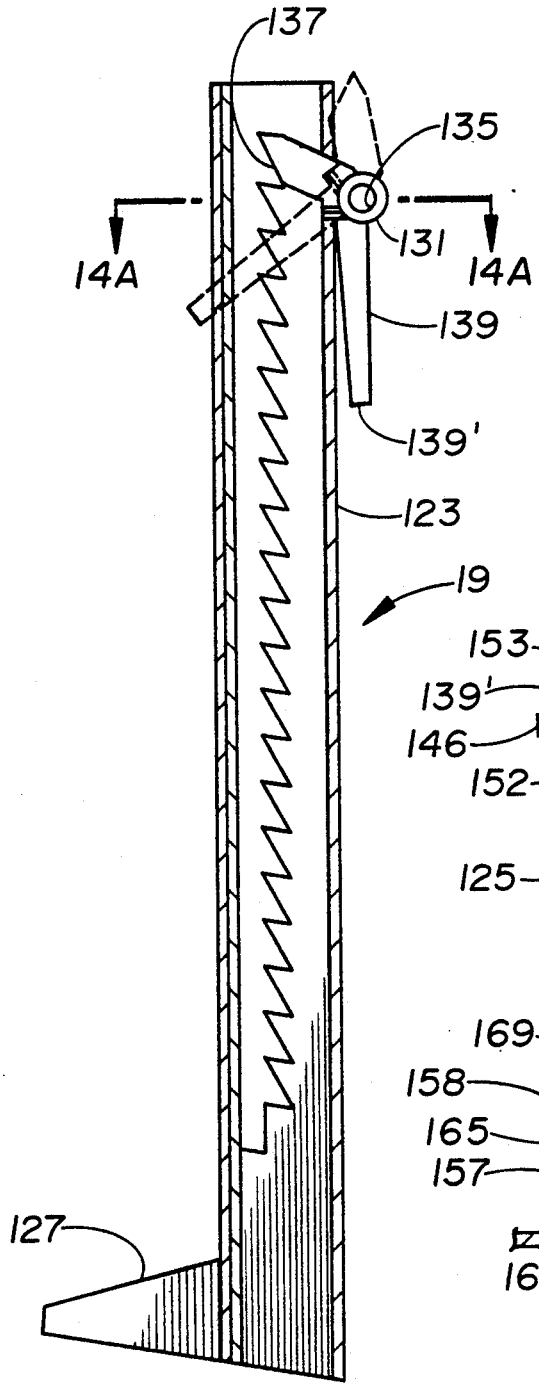
FIG. 14D is a section taken along the line 14D—14D of FIG. 14.

At the upper end of leveler 19 is a spring loaded pawl mechanism 130 that cooperates with the racks 122 and 123 to secure leveler 19 against upward thrust, once the leveler has been adjusted to the desired length. Referring to FIGS. 14, 14A and 14D, two spaced journal block pairs 131, 132 and 133, 134 extend outward from the surface of web 123 near the top of leveler 19. Journal blocks 131–134 support for free rotation a splined shaft 135. Pawls 136, 137, as seen in FIG. 14E, are respectively keyed to shaft 135 between journal blocks 131, 132 and 133, 134. The web 123 of leveler 19 is slotted beneath the space between journals 131, 132 and 133, 134 to permit shaft 135 to rotate the pawls below the surface of web 123 and into contact with the teeth of racks 122 and 122', respectively. Operating levers 138 and 139 are fixed to the opposite ends of shaft 135 to secure shaft longitudinally within journals 131–134 and to provide a means for rotating shaft 135 to raise pawls 136 and 137 out of contact with the teeth of racks 122 and 122'. Torsion springs 141, 142 are fitted coaxially over shaft 135. One end of each of the springs 141, 142 is fixed to a splined collar keyed to shaft 135. The opposite end of the spring 141 is fixed to journal block 132 and the opposite end of spring 142 is fixed to journal block 134 and the springs are tensioned to urge shaft 135 to rotate in the direction to bring pawls 136 and 137 into contact with the teeth of racks 122 and 122', respectively.

Referring to FIG. 14D, when springs 141 and 142 have rotated shaft 135 counter-clockwise to bring pawl 137 into contact with a tooth of rack 122', the end 139, of lever 139 lies slightly above the surface of web 123. In this position, leveler 19 is locked against upward movement relative to the ladder leg 18. The pawl 137 is released from engagement with rack 122' to allow upward movement of the leveler 19 relative to the leg 18 by rotating lever 139 clockwise to the position shown in dotted lines, thereby raising pawl 137 out of engagement with rack 122' and freeing the leveler 19 for sliding movement with respect to leg 18. Rotation of shaft 135, as described, concurrently moves pawl 136 and lever 138 to positions corresponding to those shown for lever 139 and pawl 137 in FIG. 14D. Flanges 124', 125, and the edges of back plate 128 are slotted along the line of travel of the ends of levers 138 and 139 so as not to obstruct rotation of the levers.

Figure 14G:
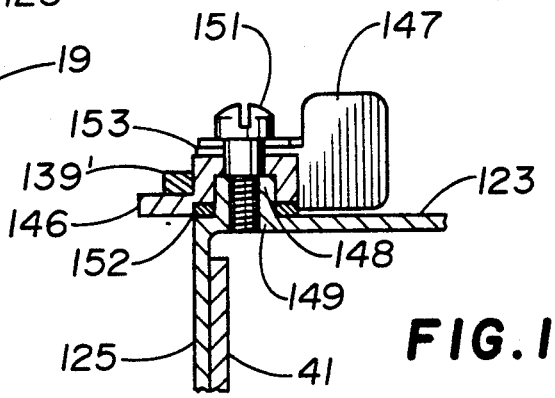
FIG. 14G is a section taken on the line 14G—14G of FIG. 14 showing the latch for locking the ratchet of the foot in an engaged position.

A latch 145, seen in FIGS. 14 and 14G, locks lever 139, and consequently lever 138, in the position in which pawls 136 and 137 are in engagement with racks 122 and 122' to prevent accidentally freeing leveler 19 for sliding movement with respect to leg 18. Latch 145 comprises a hook-like portion 146 pivotally mounted near the side 125 of leveler 19 so that, in the locked position, the outer end of portion 146 extends beneath the lower surface of lever 139, near the end 139' thereof, and blocks lever 139 from rotation in the direction to release pawl 137 from engagement with rack 122'. Referring to FIG. 14G, the inner end of latch portion 146 is formed with a cylindrical hub 148 that fits over a cylindrical boss 149 extending outward from the web 123 near the side 125 of leveler 19. A shouldered screw 151 is passed through hub 148 into boss 149 to pivotally secure latch 145 to the leveler 19. The base of boss 149 is surrounded by a serrated ring 152 formed into the surface of web 123 and the bottom periphery of hub 148 is formed with serrations that mesh with the serrations of ring 152 when hub 148 is seated on boss 149. A spring washer 153, captured by screw 151, exerts a continuous thrust on hub 148 to hold the hub serrations in resilient engagement with those of ring 152 and provide a detenting action as latch 145 is moved between locked and unlocked positions. A thumb tab 147, extending upward from hub 148, provides means for pivoting latch 145 between the position in which latch portion 146 extends under lever 139 to lock pawls 136 and 137 into engagement with racks 122 and 122', and the position in which portion 146 is retracted from under lever 139 allowing pawls 136 and 137 to move out of engagement with racks 122 and 122'.

Figure 14H:
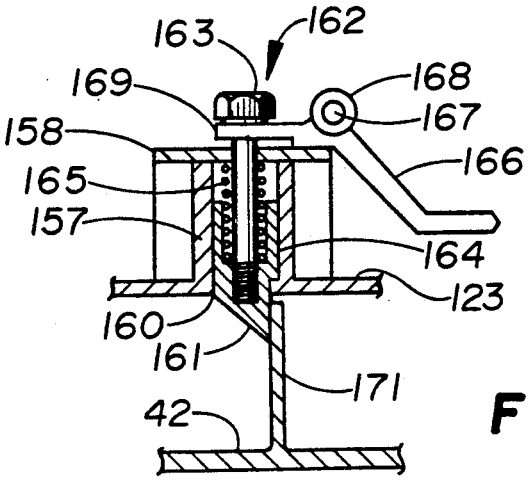
FIG. 14H is a section taken along the line 14H—14H of FIG. 14 showing the releasable stop device used to prevent inadvertent removal of the adjustable foot from the ladder leg.

Referring to FIGS. 14 and 14H, a releasable stop device 156 is provided on foot 19 to prevent the foot from being inadvertently slid completely off leg 18 during adjustment of the foot length. A generally rectangular boss 157 having a rectangular opening running the length thereof extends outward from web 123 near the upper end of foot 19. A cover plate 158, with two spaced-apart ears 159 rising above the surface of plate 158 at the lower edge thereof, is secured over the outer end of boss 157. As best seen in FIG. 14H, a rectangular slot 160 is located at the bottom of boss 157 to allow passage through web 123 by the tapered end piece 161 of a bolt assembly 162. Bolt assembly 162 includes a bolt 163 headed at the upper end and threaded at the lower end for attachment of end piece 161 and a bolt guide cup 164 having rectangular cross section. A compression spring 165 is fitted coaxially over the shank of bolt 163 so as to bear at the lower end on the bottom of bolt guide 164 and to bear at the upper end on the lower surface of cover 158. A stop release lever 166 is pivotally supported on cover 158 by a pin 167 passed through the ears 159 on cover 158 and an eye 168 formed medially along the length of lever 166. One end 169 of lever 166 is slotted to permit passage of that lever end under the head of bolt 163 and the opposite end of the lever 166 is bent toward web 123 to prevent any interference by lever 166 with the movement of the thumb tab 147 of latch 145.

Referring to FIGS. 13 and 14H, a flange 171 extends transversely across web 42 of the ladder leg 18 to serve as a stop against which the end piece 161 of bolt assembly 162 abuts when the foot 19 is fully extended with respect to leg 18. When foot 19 is first installed on leg 18, end piece 161 rides easily over flange 171 as the leveler is slid onto the leg. Levers 138 and 139 must, at the time, be held in a position to raise pawls 136 and 137 out of engagement with the teeth of racks 122 and 122'. When it is desired to remove the leveler 19 from the leg 18, the leveler is slid along the length of the leg until the bolt end piece 161 encounters the flange 171. Then the stop release lever 166 is depressed to raise the lower edge of end piece 161 above the edge of flange 171 and the leveler is slid completely off the leg. It is assumed, of course, that during removal of the leveler from the leg, latch 145 is placed in the unlocked position, allowing pawls 136 and 137 to move easily along racks 122 and 122, In setting up the ladder for use, the leveler 19 is first slid fully on leg 18 while lever 13B or 139 is being held in a position to disengage pawls 136 and 137 from racks 122 and 122'. Then, while the ladder is being held by the user in a level position, leveler 19 is slid downward along leg 18 by pressure of the user's foot on pedal 127 until the bottom flange of leveler 19 touches the ground. During such movement the pawls 136, 137 ratchet along racks 122, 122' without requiring any attention from the user. Latch 145 is in an unlocked position during this time. The stop device 146 prevents the leveler 19 from being slid completely of the leg 18 while the leveler is being so adjusted, should the amount of travel of the leveler along the leg be insufficient to level the ladder. After the leveler length is thus adjusted the required amount, latch 145 is moved to the locked position to prevent the accidental release of the pawls from the racks.

Obviously many modifications and variations in the invention are possible in the light of the above teachings. It is therefore to be understood that the invention may be practiced otherwise than as specifically disclosed without departing from the spirit and scope of the appended claims.

The invention claimed is:

1. A versatile folding ladder which may be articulated in a plurality of configurations for a variety of respective applications, including a compact configuration for convenient storage and transportation, the ladder having a pair of middle sections pivotably joined together, and a pair of end sections including a first end section pivotably joined to one of the middle sections and a second end section pivotably joined to the other of the middle sections such that a plurality of pivot joints are formed between the respective sections, the end sections and middle sections each including a pair of side rails and further including a plurality of transverse rungs joined to the respective side rails, each of the side rails being molded of a composite material and including a pair of filets and metal reinforcing rods embedded within and keyed to the respective filets in the side rails such that the ladder has a relatively high strength and is relatively lightweight, and such that the ladder has improved electrical safety, and "master" pivot means all on the first side of the ladder and cooperating with "slave" pivot means all on the second side of the ladder at the pivot joints between the respective sections, whereby locking and unlocking of each pivot joint is accomplished by operating the respective "master" pivot means, said "slave" pivot means being actuated thereby to allow convenient adjustment of the ladder to a desired articulated position.

2. The improvement of claim 1, wherein said composite material comprises a resin impregnated glass fiber material.

3. The improvement of claim 1, wherein the middle sections are substantially identical to each other.

4. The improvement of claim 1, wherein the respective side rails on at least one of the end sections have foot means carried thereon, such that the ladder may rest upon the ground or floor, and at least one of the foot means being adjustable in height relative to the respective side rail, thereby facilitating a leveling of the ladder.

5. A section of a multi-section ladder, comprising:

a pair of parallel side rails;

a plurality of rungs extending transversely between said side rails at spaced intervals along the lengths of said side rails, said side rails and said rungs being integrally formed from molded composite material; and each of said side rails including two parallel side flanges and a web extending perpendicularly between and joined to said side flanges along an edge of each of said flanges to form a generally U-shaped channel, and at least one fillet extending along a juncture of said web and one of said side flanges;

a plurality of reinforcement rods each embedded in a corresponding one of said fillets and extending substantially the length of said side rails, said reinforcement rods including keying means extending lengthwise.

6. A section of a ladder as claimed i claim 5, wherein:

each of said rungs is generally tubular in form with a hollow center extending substantially the length thereof.

7. The section of a ladder as claimed in claim 5, wherein said reinforcement rods are metal.

8. A folding ladder comprising:

a pair of like end sections;

an even number of like middle sections;

each of said first end sections including:

first and second parallel side rails formed with two parallel side flanges and a web extending perpendicularly between said side flanges in a generally U-shaped channel, said first and second parallel side rails further including a pair of filets extending along opposite edges of said web to join an edge of one of said side flanges to an edge of said web, and a pair of reinforcement rods each being embedded in and keyed to one of said filets;

a plurality of rungs extending transversely between said side rails at intervals spaced along the length of said side rails;

a male hinge component at one end of said first side rail;

a female hinge component at the end of said second side rail corresponding to said one end of said first side rail;

each of said middle sections including:

first and second parallel side rails;

a plurality of rungs extending transversely between said side rails of said middle section at intervals spaced along the length of said side rails of said middle section; 'a male hinge component at each end of said first middle section side rail;

a female hinge component at each end of said second middle section side rail;

each said male hinge component and each said female hinge component being adapted to be pivotally joined together in mating relationship; and a plurality of pivot devices, one each for each mating pair of one of said male hinge component with one said female hinge component;

said middle sections being connected to one another at the ends thereof by a pair of hinge joints;

one each of said end sections being joined to one each of the opposite ends of said connected middle sections by a pair of hinge joints;

each of said hinge joints including:

one of said male hinge components on an end of one of said first side rails;

one of said female hinge components on an end of one of said second side rails; and one of said pivot devices.

9. A folding ladder as claimed in claim 8, with additionally:

at least one adjustable leg leveler, said leg leveler being fitted to one of the ends of said first and second side rails of said end sections, opposite said ends of said first and second side rails of said end sections having one of said hinge components thereon, said leg leveler including means for releasably securing said leveler to said side rail to which said leveler is fitted for extending the length of said side rail by a selected amount.

10. A folding ladder as claimed in claim 8, wherein:

said male hinge components and said female hinge components are each disk-like in form with an open center for receiving one said pivot device, said male hinge components each having at least one stud projecting from the face of said disk thereof, said female hinge components each having at least one depression formed on the face of said disk thereof for receiving said stud when one said male hinge component is brought into facing relationship therewith, said facing hinge components thereby being restrained against rotation relative to one another.

11. A folding ladder as claimed in claim 10, wherein:

the centers of said disks of said hinge components at the ends of said first and second side rails of each said end sections are each offset by the same particular amount from the same side of the longitudinal axis of each said first and second side rails of each said end section;

the centers of said disks of said hinge components on said first and second side rails of said middle sections, at one end of each said middle sections, are offset by said same particular amount from a first side of the longitudinal axis of each said first and second side rails of said middle section, and the centers of said disks of said hinge components on said first and second side rails of said middle sections, at the end of each said middle sections opposite said one end, are offset by said same particular amount from the side of the longitudinal axis of said first and second side rails opposite said first side of offset, whereby, the longitudinal axes of said first and second side rails of said end sections and the longitudinal axes of said first and second side rails of said middle sections all lie substantially parallel to one another when said ladder is folded.

12. A folding ladder as claimed in claim 10, wherein:

said pivot devices of said hinge joints coupling said middle sections together and said hinge joints coupling said end sections to said middle sections, on at least one side of said ladder, are each of a master-type, each master-type being adjustable between first and second positions and including:

means for firmly clamping together in facing relationship said disks of said hinge components with which said master-type pivot device is associated when said master-type pivot device is adjusted to said first position; and means for resiliently urging together in facing relationship said disks of said hinge components with which said master-type pivot device is associated when said master-type pivot device is adjusted to said second position.

13. A folding ladder as claimed in claim 12, wherein:

said pivot devices of said hinge joints coupling said middle sections together and said hinge joints coupling said end sections to said middle sections, on the side of said ladder opposite said one side, are each of a slave-type;

each said slave-type pivot device including:

means for resiliently urging together in facing relationship said disks of said hinge components with which said slave-type pivot device is associated.

14. A folding ladder as claimed in claim 13, wherein:

said pivot devices of said hinge joints coupling middle sections together and said hinge joints coupling said end sections to said middle sections, along the same one side of said ladder, are each of said master-type; and said pivot devices of said hinge joints coupling said middle sections together and said hinge joints coupling said end sections to said middle sections, in said hinge joints on the same side of said ladder opposite said one side of said ladder, are each of said slave-type.

15. In a versatile folding ladder which may be articulated in a plurality of configurations for a variety of respective applications, such that the ladder may be folded into a compact size for convenient storage and transportation, wherein the ladder further has a pair of middle sections pivotably joined together and further has a pair of end sections, including a first end section pivotably joined to one of the middle sections, and further including a second end section pivotably joined to the other of the middle sections, such that a plurality of pivot joints are formed between the respective sections, each of the sections including a pair of side rails and further including a plurality of transverse rungs joined to the respective side rails, the improvement comprising said middle sections being identical to each other and integrally molded in a single "shot", and the end sections being identical to each other and integrally molded in a single "shot", and reinforcing means for reinforcing at least one side rail of at least one of said middle sections and end sections, said reinforcing means further comprising a threaded steel rod internally of said side rail and keyed thereto to provide high strength, reduced manufacturing costs and weight, and improve electrical safety.

16. The improvement of claim 15, further including leveling means carried by one of the side rails of one of the end sections.

17. The improvement of claim 15, wherein the molded material comprises a resin impregnated glass fiber material.

18. The improvement of claim 15, wherein the ladder has respective sides including a first side and a second side, and wherein "master" pivot means are provided all on the first side of the ladder and cooperating with "slave" pivot means all on the second side of the ladder at the pivot joints between the respective sections, such that the ladder may be laid on its second side for locking and unlocking the pivot joints, and such that the ladder may be conveniently adjusted to a desired articulated position.

19. A folding ladder comprising:

a plurality of ladder sections;

each of said ladder sections including:

first and second parallel side rails;

a plurality of rungs extending transversely between said side rails at intervals spaced along the length of said side rails;

a plurality of hinge joints for pivotably connecting together said ladder sections into an articulated series of said ladder sections, one each of said hinge joints connecting the facing ends of said side rails of each adjoining pair of said ladder sections;

leveler receiving means on each said side rail of an endmost one of said ladder sections of said series of ladder sections, said leveler receiving means being located on said side rail along an end of said side rail opposite the end thereof connected to an adjoining ladder section by one of said hinge joints, said leveler receiving means further including, first and second racks of ratchet teeth extending in parallel along said side rail; and a leveler fitted to at least one of said side rails having leveler receiving means thereon, said leveler further including, a sleeve-like body slidably fitted over the end of said one side rail, a shaft extending transversely to said body and mounted on said body for pivotal motion, first and second pawls keyed to said shaft so as to respectively engage said ratchet teeth of said first and second racks said first and second pawls being pivotably mounted on said shaft near the upper end of said body to engage said ratchet teeth of said first and second rack, spring means for biasing said first and second pawls toward engagement with said respective racks of ratchet teeth, said ratchet teeth of said first and second racks and said respective first and second pawls being arranged to permit sliding movement of said leveler body along said one side rail in the downward direction to extend the length of said one side rail and to prevent sliding movement of said leveler body along said one side rail in the upward direction when said first and second pawls are in engagement with said ratchet teeth of said respective first and second racks, a lever fixed to said shaft for pivoting said shaft thereby to pivot said first and second pawls out of engagement with said ratchet teeth of said first and second racks to permit sliding movement of said leveler body along said one side rail in the upward direction, a pedal extending outward from said body to enable a user of said ladder to extend said leveler along said one side rail by pressure of the user's foot on said pedal, and a releasable latch fixed to said body for locking said lever against motion in a direction to pivot said first and second pawls out of engagement with said ratchet teeth of said first and second racks.

20. A versatile folding ladder articulate in a plurality of configurations for a variety of respective applications, including a compact configuration for convenient storage and transportation, comprising at least four sections pivotably connected together and including two middle sections and two end sections, the end sections resting upon the ground or other supporting surface and the middle sections being elevated above the ground or other supporting surface in the normal articulated configuration of the ladder, the middle sections being substantially identical to each other and the end sections being substantially identical to each other, each of the sections being integrally molded, such that only two molds are required for manufacturing efficiency and economy, each of the sections including respective side rails and transverse rungs integrally molded with the side rails, thereby avoiding assembly of the rungs to the side rails for additional manufacturing efficiency and economy, and each of the side rails on at least the end sections of the ladder having threaded metallic rods embedded therein, thereby resulting in an articulate ladder which is sturdy and lightweight, has improved electrical safety, and is economical to manufacture.

21. The ladder of claim 20, wherein the side rails have respective fillets, and wherein the threaded metallic rods are embedded in the fillets.

22. The ladder of claim 20, wherein pivot means are provided between the respective sections, and wherein the pivot means includes a "master-slave" locking structure enabling the pivot means to be manipulated from a single side of the ladder, such that six pivot joints are provided, but only three manipulations are required.

23. The ladder of claim 20, wherein the respective sections are molded from a glass fiber reinforced material randomly disposed therein.

24. A ladder section, comprising a unitary article of manufacture molded from glass fiber reinforced resin and including a pair of side rails and transverse members integral therewith, the members being tubular and having a wall thickness substantially equal to the wall thickness of the side rails, and the side rails each having a threaded steel rod embedded therein and keyed to the composite material, thereby providing a lightweight ladder section having the required strength and stiffness.

25. A ladder section, comprising a unitary article of manufacture molded from a glass fiber reinforced material and including a pair of channel-shaped side rails and transverse rungs integral therewith, and a threaded steel rod embedded in each of the side rails and keyed thereto, thereby providing a lightweight ladder section having the required degree of strength and stiffness.

26. The ladder section of claim 25, wherein the rungs are tubular and have a wall section substantially equal to the wall section of the molded side rails.

27. The improvement of claim 3, wherein the end sections are substantially identical to each other.

* * * * *